US008320799B2

(12) United States Patent
Yoshida et al.

(10) Patent No.: US 8,320,799 B2
(45) Date of Patent: Nov. 27, 2012

(54) RECYCLING IMAGE FORMING APPARATUS

(75) Inventors: Ryuji Yoshida, Yokohama (JP); Mikio Ishibashi, Yokohama (JP); Nobuyuki Koinuma, Yokohama (JP); Hideki Zenba, Kawasaki (JP); Naoyuki Ozaki, Zama (JP); Hiroaki Maeda, Ebina (JP); Mugijirou Uno, Isehara (JP); Shunichi Hashimoto, Yokohama (JP); Yoshinori Nakagawa, Yokohama (JP); Tomoko Takahashi, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 259 days.

(21) Appl. No.: 12/881,822

(22) Filed: Sep. 14, 2010

(65) Prior Publication Data

US 2011/0064475 A1 Mar. 17, 2011

(30) Foreign Application Priority Data

Sep. 15, 2009 (JP) ..... 2009-213232

(51) Int. Cl.
*G03G 15/08* (2006.01)

(52) U.S. Cl. ..... 399/258; 399/260

(58) Field of Classification Search ..... 399/82, 399/85, 258, 260, 262
See application file for complete search history.

(56) References Cited

U.S. PATENT DOCUMENTS

| | | | | |
|---|---|---|---|---|
| 6,947,682 | B2 | 9/2005 | Kosugi et al. | |
| 7,155,152 | B2 | 12/2006 | Iwai et al. | |
| 7,672,605 | B2 | 3/2010 | Kayahara et al. | |
| 7,747,198 | B2 * | 6/2010 | Nakagami | 399/260 |
| 7,925,182 | B2 * | 4/2011 | Ishiguro et al. | 399/113 |
| 2007/0116494 | A1 | 5/2007 | Uno et al. | |
| 2007/0280742 | A1 | 12/2007 | Matsumoto et al. | |
| 2008/0175628 | A1 | 7/2008 | Kita et al. | |
| 2008/0181630 | A1 | 7/2008 | Matsumoto et al. | |
| 2009/0016777 | A1 | 1/2009 | Miyamoto et al. | |
| 2009/0103935 | A1 | 4/2009 | Uno et al. | |
| 2009/0110425 | A1 | 4/2009 | Uno et al. | |
| 2009/0180813 | A1 | 7/2009 | Yoneda et al. | |
| 2009/0232526 | A1 | 9/2009 | Yoneda et al. | |

(Continued)

FOREIGN PATENT DOCUMENTS

| | | |
|---|---|---|
| JP | 2003-66685 | 3/2003 |
| JP | 2003-66686 | 3/2003 |

OTHER PUBLICATIONS

U.S. Appl. No. 12/828,612, filed Jul. 1, 2010, Furuya, et al.
U.S. Appl. No. 12/879,585, filed Sep. 10, 2010, Takahashi, et al.

*Primary Examiner* — Hoang Ngo
(74) *Attorney, Agent, or Firm* — Oblon, Spivak, McClelland, Maier & Neustadt, L.L.P.

(57) ABSTRACT

An image forming apparatus includes a first image formation unit that forms a black toner image, and a detachable second image formation unit that forms a color toner image. A first toner supply unit is provided to supply the black toner to the first image formation unit. A second toner supply unit is provided to supply one of a black and component color toner to the first and second image formation units in accordance with a color mode. A first conveyance path is provided to convey the black toner to the first image formation unit. A second conveyance path is also provided to convey the component color toner stored in the second toner container section to the second image formation unit. The second toner supply unit is selectively connected to one of the first and second conveyance paths in accordance with the color mode.

7 Claims, 6 Drawing Sheets

U.S. PATENT DOCUMENTS

2009/0279906 A1 11/2009 Kuma et al.
2010/0040393 A1 2/2010 Kawahara et al.
2010/0061752 A1 3/2010 Sudo et al.
2010/0239294 A1 9/2010 Kosako et al.

* cited by examiner

RECYCLING IMAGE FORMING APPARATUS

CROSS-REFERENCE TO RELATED APPLICATIONS

This application claims priority under 35 USC §119 to Japanese Patent Application No. 2009-213232, filed on Sep. 15, 2009, the entire contents of which are herein incorporated by reference.

BACKGROUND OF THE INVENTION

1. Field of the Invention

The present invention relates to an image forming apparatus, such as a printer, a copier, a facsimile machine, etc.

2. Discussion of the Background Art

Recently, for the purpose of conserving the global environment, it is demanded that natural resources are saved and $CO_2$ outputs are reduced. Companies can play a large role in meeting such a demand, because they can greatly contribute to conservation of the global environment by recycling their products and saving natural resources.

In a field of office equipment, replacement is frequent and lease contracts of printers and/or copiers are short. However, at present almost all of parts collected by the manufacturers are discarded and not recycled. Part of the reason is that, technical innovation is rapid and new products often include significantly different structures from previous products even one generation old. Thus, for example, a casing or an image formation unit or the like cannot be reused, presently. To increase efficiency of information transmission or to enrich visual effectiveness, a monochrome instrument is sometimes replaced with a color instrument. Conversely, to save cost, a color instrument is sometimes replaced with a monochrome instrument.

However, due to structural differences, even the same casing or the image formation unit or the like is hardly used in a new product. In general, the monochrome instrument more quickly forms images and is more productive than the color instrument. Thus, it is more natural that a new monochrome instrument is provided without recycling the color instrument.

In Japanese Patent Application Laid Open Nos. 2003-66685 and 2003-66686 (JP-2003-66685-A, JP-2003-66686-A), a method of recycling an intermediate transfer tandem type color image forming apparatus as a monochrome instrument is discussed. Specifically, a color image forming apparatus includes a black color (B) image formation unit having a B-color image bearer for carrying a B-color toner image, a yellow color (Y) image formation unit having a Y-color image bearer for carrying a Y-color toner image, a magenta color (M) image formation unit having a M color image bearer for carrying a M color toner image, and a cyan yellow color (C) image formation unit having a C color image bearer for carrying a C color toner image, each horizontally arranged side by side.

Below the above-mentioned image formation units, an intermediate transfer unit including an intermediate transfer belt is arranged. The intermediate transfer belt is tightly stretched and rotated by three supporting rollers, and contacted by each of the above-mentioned image formation units along a stretching region between first and second supporting rollers. As shown there, the image formation units of Y, M, C, and B colors are arranged in the intermediate transfer belt moving direction in this order. Further, Japanese Patent Application Laid Open No. 2003-66686 describes plural image formation units of C, M, B, and Y colors arranged in an intermediate transfer belt moving direction in this order.

When a color instrument is recycled as a monochrome instrument, the image formation units of Y, M, and C serving as second image formation units are generally detached. The intermediate transfer unit is also detached from the apparatus, and an intermediate transfer belt for the monochrome instrument is attached below the B-color image formation unit serving as a first image formation unit. The intermediate transfer belt of the monochrome instrument is tightly stretched and rotated by three supporting rollers. Specifically, the intermediate transfer unit of the monochrome instrument is attached so that a stretching region between the first and second supporting rollers of the intermediate transfer belt is contacted by an image bearer of B color. As a result, a distance from a contact position (i.e., a primary transfer position) between the intermediate transfer belt of B color and the image bearer to the supporting roller (of the belt conveyance) arranged downstream is shorter in the intermediate transfer unit of the monochrome instrument than in that of the color instrument. Thus, a length of the intermediate transfer belt of B color from the first to section transfer positions decreases, and accordingly, a first printing out time is shorter in the monochrome instruments recycled from the color instruments.

However, in these conventional image forming apparatuses, three toner container sections storing Y, M, and C color toner, respectively, and color use toner supply units serving as second toner supply units are provided to supply the color use toner to the image formation units of Y, M, and C colors, respectively. Separately, a toner container section storing black toner, and a black use toner supply unit serving as a first toner supply unit are also provided to supply the black toner to the image formation unit of B color.

The problem with this arrangement is that when the color instrument is recycled as the monochrome instrument, the color use toner supply units are detached from the apparatus and discarded together with color use image formation units. As a result, saving of the resources and recycling of the products are insufficient.

SUMMARY OF THE INVENTION

Accordingly, an object of the present invention is to provide a new and novel image forming apparatus. Such a new and novel image forming apparatus includes a first image formation unit that forms a black toner image, a detachable second image formation unit that forms a color toner image, and a first toner container that stores black toner. A first toner supply unit is provided to supply the black toner to the first image formation unit. A second toner container is provided to store one of black and component color toner in accordance with a color mode. A second toner supply unit is provided to supply one of the black and component color toner from the second toner container to the first and second image formation units in accordance with the color mode. A first conveyance path is provided to convey the black toner stored in the second toner container to the first image format ion unit. A second conveyance path is also provided to convey the component color toner stored in the second toner container section to the second image formation unit. The second toner supply unit is selectively connected to one of the first and second conveyance paths in accordance with the color mode. The image forming apparatus serves as a color image forming apparatus forming the color toner image when the second image formation unit is attached, and as a monochrome image forming apparatus forming the black toner image when the second image formation unit is detached.

In another aspect, the first toner supply unit is connected to a third conveyance path connecting to the first image formation unit. The third conveyance path includes an interflow section where the first conveyance path interflows.

In yet another aspect, the second conveyance path includes a conveyance tube with its one end being secured to the second toner container, while the other end being selectively detached and attached to one of the interflow section and the second image formation unit in accordance with the color mode.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENTS OF THE PRESENT INVENTION

Figure 1:
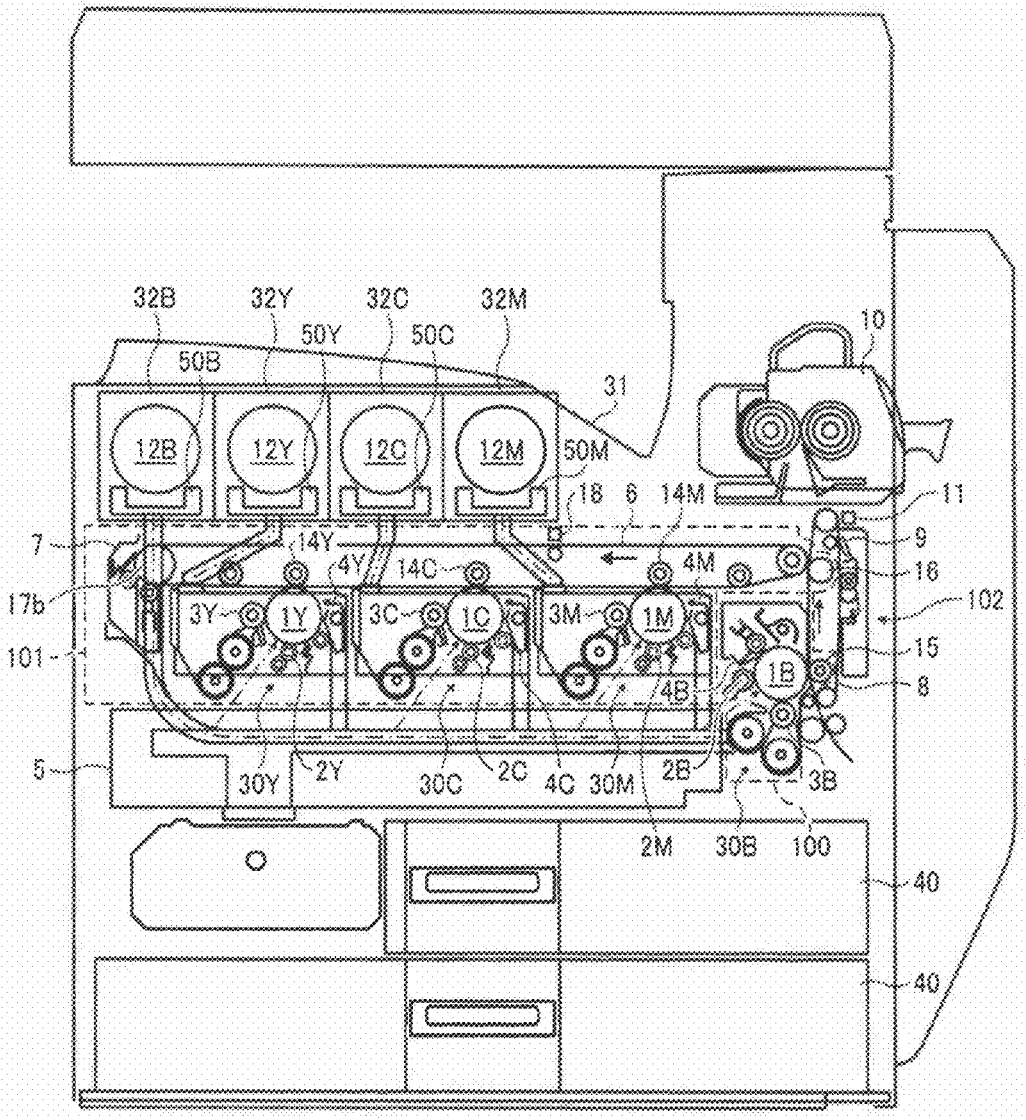
FIG. 1 schematically illustrates an exemplary image forming apparatus according to a first embodiment of the present invention.

Referring now to the drawing, wherein like reference numerals designate identical or corresponding parts throughout several views, in particular in FIG. 1, an image forming apparatus includes a black (B) image formation unit 100 as a first image formation unit, and a color image formation unit 101 as a second image formation unit.

The image formation unit 101 includes three process units 30Y to 30M as second image forming devices for yellow, cyan, and magenta uses, and an intermediate transfer unit having an intermediate transfer belt or the like. These three process units 30Y to 30M are serially arranged along the intermediate transfer belt 6 in tandem. Further, the black color image formation unit 100 is independently arranged upstream of such a tandem arrangement of the image formation units in a recording medium moving direction, so that a black toner image formed by the process unit 30B can be directly transferred onto a recording medium.

The intermediate transfer unit includes plural primary transfer rollers 14Y to 14M and an intermediate transfer belt cleaner 7 beside the intermediate transfer belt 6. The intermediate transfer belt 6 is supported by driving and driven plural rollers 17*a* and 17*b*. The primary transfer rollers 14Y to 14M are arranged inside the intermediate transfer belt 6 opposing the respective photoconductive drums 1 with a slight deviation downstream. A cleaning device 7 is arranged on the out of the intermediate transfer belt 6 to remove toner remaining thereon.

A secondary transfer roller 16 as a secondary transfer device is arranged opposing the driving roller 17*a*, and creates a nip with the intermediate transfer belt 6 via a transfer conveyance belt 8.

In a space below the fixing device 10 on the right side of the intermediate transfer belt 6 in the drawing, there is provided a sheet conveyance device 102. The sheet conveyance device 102 almost extends horizontally while vertically intersecting with the intermediate transfer belt 6, including the above-mentioned transfer conveyance belt 8. The transfer conveyance belt 8 is tightly stretched and is freely rotated by plural stretching rollers.

The B-image formation unit 100 includes a process unit 30B and a direct transfer roller 15 or the like. The B-color process unit 30B is independently arranged from the Y to C color process units 30Y to 30C upstream of the secondary transfer nip in the recording medium moving direction, so that a toner image of the process unit 30B can be directly transferred onto the recording medium (i.e. a recording sheet). More specifically, the B-process unit 30B is arranged adjacent and along with the vertical conveyance path of the recording medium. Specifically, the direct transfer roller 15B is arranged opposing the photoconductive member 1B via the transfer conveyance belt 8, so that a direct transfer nip is created between the photoconductive member 1B and the direct transfer roller 15B via the transfer conveyance belt 8.

The process units 30Y to 30B of the respective colors of FIG. 1 include image bearers 1Y to 1B, respectively. Further, there are provided charge devices 2Y to 2B for charging the surfaces of the photoconductive members 1Y to 1B, developing devices 3Y to 3B for supplying toner to latent images to obtain toner images thereon, and cleaning devices 4Y to 4B around the respective photoconductive members 1Y to 1B. The cleaning devices are not limited to a blade type, and far brush rollers or magnetic brush rollers can be employed. Further, the respective process units 30Y to 30B are detachable to the image forming apparatus body as process cartridges, respectively.

Below the color image formation unit 101, there is provided an exposure device 5 as a latent image formation device to form latent images on the surface of the photoconductive members 1Y to 1B carrying charges by emitting laser lights thereonto. The exposure device is not limited to the laser system, and an LED system can be employed.

The image forming apparatus of this embodiment operates both in a full-color mode as a first image formation mode in which a full-color image is obtained from Y to M toner images, and a monochrome mode as a second image formation mode in which a monochrome image is obtained from a black toner image, each on a recording medium. These modes are switched by a control section of the image forming apparatus, not shown, in accordance with image data.

Initially, the full-color mode is described. Initially, color image information read from an original document by a scanner, that received by a facsimile, or that transmitted from a computer is resolved into respective component colors, whereby color plates thereof are generated. Then, such data is transmitted to the exposure device 5. The photoconductive members 1Y to 1B are uniformly charged and an image section thereof is exposed by the exposure device 5. Then, the developing devices 3Y to 3B create toner images, respectively.

To each of the primary transfer rollers 14Y to 14M, a high voltage having an opposite polarity to the toner is provided, so that electric fields are created and the respective toner images on the photoconductive members 1Y to 1M are superimposed one by one onto the intermediate transfer belt 6 in the electric fields. Thus, a color image having triple colors is formed on the intermediate transfer belt 6.

The color image on the intermediate transfer belt 6 is transferred in the secondary transfer nip formed by the secondary transfer roller 16 and the opposing roller 17*a* onto a recording medium conveyed thereto by the transfer conveyance belt 8 under the voltage applied therebetween. At this moment, a high voltage having an opposite polarity to a charge polarity of the toner can be applied to the secondary transfer roller 16. Otherwise, a voltage having the same polarity as that of a charge of toner can be applied to the opposing roller 17*a*.

When such a high voltage having the opposite polarity to the charge of the toner is applied to the secondary transfer roller 16, a high-voltage power supply that supplies a voltage to the direction transfer roller 15B becomes available, and accordingly, a private use power supply for supplying a voltage to the secondary transfer roller 16 can be omitted. Thus, the cost can be saved while downsizing the image forming apparatus. Further, when the above-mentioned voltage having the same polarity as that of the charge of toner is applied to the opposing roller 17*a*, the transfer process is excellent, because the voltage is applied to the toner via the intermediate transfer belt 6 even if the recording medium absorbs moisture and decreases its resistance.

The recording mediums to carry output images are accommodated in the sheet-feeding tray 40, and are conveyed therefrom to the transfer conveyance belt 8 and the direct transfer nip. Then, the black toner image formed on the photoconductive member 1B is directly transferred onto the recording medium in the direct transfer nip. The recording medium carrying the black toner image in the direct transfer nip is further conveyed to the second transfer nip by the transfer conveyance belt 8, so that triple color toner images formed on the intermediate transfer belt are transferred onto the black toner image as a secondary transfer process.

In this way, the recording medium carrying the toner images of Y to M colors separates from a bending section by its own rigidity, where a rotational direction of the transfer conveyance belt 8 sharply changes downstream of the secondary transfer nip, and arrives at the fixing device 10. Then, the toner images of Y to B are finally fixed onto the recording medium and a full-color image is created thereon. The recording medium completing the fixing process is conveyed to a sheet ejection path R, and is ejected and stacked by a pair of sheet ejection rollers, not shown, onto a sheet ejection tray 31 with its face facing down.

Now, a monochrome mode is described. During monochrome image formation, the exposure device 5 exposes an image section on the photoconductive member 1B in accordance with data of a black image which is read by a scanner from an original document, received by a facsimile, or transmitted from a computer. Then, a black image is formed by a developing device 3B and is directly transferred onto a recording medium conveyed thereto by the transfer conveyance belt 8. The black toner image is then fixed onto the recording medium by the fixing device 10.

Further, a separation mechanism separates a contact section of a secondary nip formed between the intermediate transfer belt 6 and the transfer conveyance belt 8. Thus, even if the process units 30Y to 30M and the intermediate transfer belt 6 are not operated, formation of the monochrome image is not affected. Thus, owing to the non-operation, deterioration of the process units 30Y to 30M and the intermediate transfer belt 6 can be suppressed and their lives can be prolonged.

The above-mentioned direct transfer brings advantages such that a number of parts is decreased, and the exposure device 5 can write a black image with a laser light in the same direction with the other component color images. Further, due to the direct transfer, the black image is more efficiently transferred onto the recording medium than the other component colors of Y to M images, because the latters are transferred via the intermediate transfer belt. Thus, an amount of toner consumption when a black image is directly transferred from the photoconductive member 1B onto the recording medium is less than when being transferred thereonto via the intermediate transfer belt.

Further, plural optical sensors 11 and 18 are arranged opposing the outer surface of one of the toner conveyance belt 8 and the intermediate transfer belt 6 downstream of a position where transfer processes for four component colors of toner images are completed. Then, a control section, not shown, including a CPU, a memory, etc., for generally controlling the image forming apparatus executes process control at a time of a sheet interval or the like. Plural pattern images for image density detection use are formed on the respective photoconductive members 1*y* to 1B, and are ultimately transferred onto the toner conveyance belt 8 or the intermediate transfer belt 6. Image density of the patterns is detected by the optical sensor based on a reflection light. Then, the control section adjusts an image formation condition based on the detection result, whereby the density of the image on the recording medium can be maintained at a prescribed appropriate level.

Further, pattern images for color deviation detection use are formed on the toner conveyance belt 8 or the intermediate transfer belt 6, and are detected by the optical sensor. Thus, the position deviation between the images of Y to B can be detected. Thus, by adjusting positions of image formation for the respective colors while controlling image formation conditions for them, the respective images of Y to B can coincide.

Reference 9 denotes a toner conveyance belt-cleaning device that removes extraneous matter, such as toner, etc., attached onto the front surface of the toner conveyance belt 8 therefrom.

Above the intermediate transfer belt 6, the toner supply units 32B to 32M are arranged. Plural bottle setting tables 50B to 50M are included in the toner supply units, and include black, yellow, cyan, magenta color bottles 12B to 12M, respectively. Toner installed in the respective toner bottles are supplied to developing devices 3 via the conveyance tubes. In this embodiment, the bottle setting table 50B serves as a first toner container section, and the bottle setting tables 50Y to 50M serve as second toner container section. Further, the toner supply unit 32B serves as a first toner supply unit, and the toner supply units 32Y to 32M serve as second toner supply units.

Figure 2:
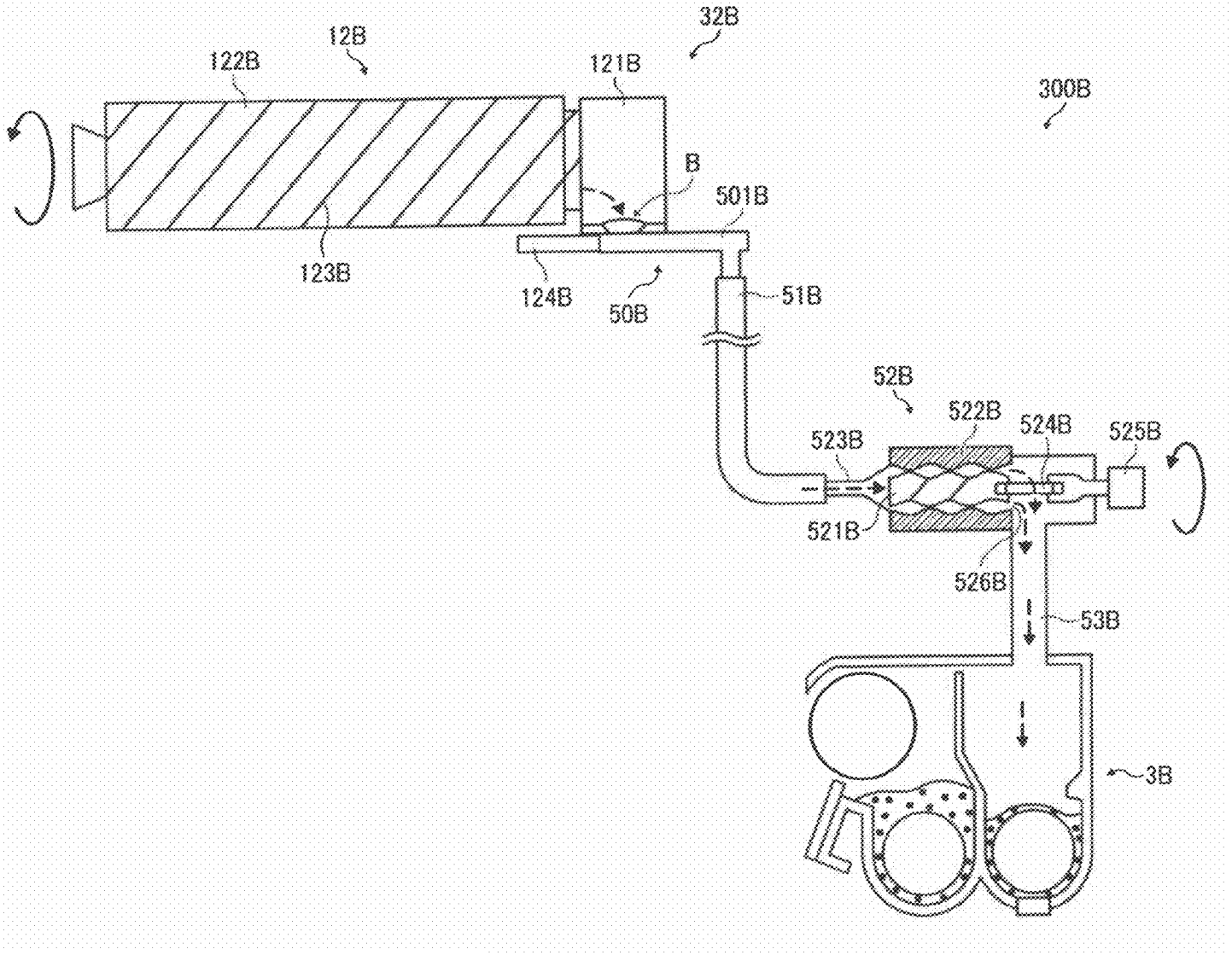
FIG. 2 schematically illustrates an exemplary toner replenishment device for replenishing black color.

Now, with reference to FIG. 2, an essential structure of a toner replenishment device 300B that guides toner stored in the toner bottle 12*b* to the developing device 3B is described.

The toner replenishing device 300B includes a toner supply unit 32B, a screw pump 52B (e.g. a Mohno-pump) serving as a component of the black toner image formation unit 100. The toner supply unit 32B includes a toner bottle 12B as a toner container, a bottle setting table 50B receiving a toner bottle 12B set thereto, and a driving section that rotates and drives a container body 122B of the toner bottle 12B.

By connecting a cap section 121B for the toner bottle to the bottle setting table 50B of the toner supply unit 32B, the toner bottle 12B is attached and set to the toner supply unit 32B. When the cap section 121B of the toner bottle is set to the bottle setting table 50B of the toner supply unit 32B, an opening cap member 124B of the toner bottle 12B opens a toner ejection outlet B formed on the cap section 121B. The container body 122B of the toner bottle 12B is rotated by a motor, not shown, in an arrow showing direction in the drawing. Further, on an internal circumferential surface of the container body 122B, there is provided a spiral protrusion 123B, i.e., a spiral groove when viewed from the outer circumferential surface. Thus, by rotating and driving the container body 122B in the arrow showing direction in the draw, the toner stored in the container body 122B is guided toward an opening section, not shown, formed on the container body 122B, and is ejected to the cap section 121B there through by the spiral groove 123B of the protrusion 123B. The toner being ejected onto the cap section 121B is then conveyed into a nozzle 501 via the toner ejection outlet B through a sucking opening, not shown, formed on the bottle setting table 50B. The cap section 121B does not operate at the same time with the container body 122B even when it rotates, and is held stationed by the bottle setting table 50B of the toner supply unit 328.

A connection opening of the nozzle 501 in the bottle-setting table is connected to one end of the conveyance tube 51B serving as a conveyance tube. The conveyance tube 513 is made of flexible material having an excellent toner resistant performance. The other end of the conveyance tube 51B is connected to a screw pump 52B (e.g. a Mohno-pump) serving as a toner conveyance device.

The screw pump 52B is a uniaxial eccentricity sucking type, and includes a rotor 521B, a stator 522B, an sucking opening 523B, a universal joint 524B, and a motor 525B or the like. The rotor 521B, the stator 522B, and the universal joint 524B or the like are installed in a casing, not shown. The stator 522B is made of elastic material, such as rubber, etc., having a female screw member like shape. The stator 522B includes spiral grooves of a double pitch. The rotor 521B has a shaft made of rigid material, such as metal, etc., twisted in a mail screw member like shape. The rotor 521B includes spiral grooves of a double pitch, and freely rotatably fits into the stator 522B. One end of the rotor 521B is freely rotatably connected to a motor 525B via the universal joint 524B.

When the motor 525B derives and rotates the rotor 521B in the stator 522B in a prescribed direction (i.e., clockwise when viewed from upstream in the toner conveyance direction), the screw pump 52B generates a suction force in the suction opening 523B, so that air in the conveyance tube 51B is evacuated and generates a negative pressure therein. Thus, the toner is sucked together with the air to the suction opening 523B along the conveyance tube 51B. The toner thus sucked to the sucking opening 523B is launched into a gap between the stator 522B and the rotor 521B, and is conveyed to the other end as the rotor 521B rotates. The toner thus conveyed is ejected from a launching opening 526B formed on the screw pump 52B and is replenished into the developing device 3B via the toner conveyance tube 53B.

The toner replenishing devices 300Y to 300C for Y to C colors essentially include the same structures as that of 300B.

Admitting that the other color toner mixes into the black toner, the secondary transfer nip can be arranged upstream than the direct transfer nip in the recording medium conveyance direction.

The image forming apparatus of this embodiment can be reused and recycled as a monochrome instrument. When such recycling is executed, a color image formation unit 101 that includes process units 30Y to 30M, an intermediate transfer unit, transfer rollers, and screw pumps is detached from the apparatus body together with a color driving unit that drives the process units 30Y to 30M, the intermediate transfer unit, the transfer rollers, and the screw pumps. As shown, the black color process unit 30B is independent from the other process units Y to M as well as the intermediate transfer belt so as to directly transfer an image onto a recording medium. Thus, when such recycling is executed, the black color image formation unit 100 (the process unit 30B, the direct transfer roller, and the screw pump), the sheet conveyance path, the exposure device, the fixing device, the black toner supply unit or the like do not need to be replaced. Thus, almost the same productivity can be maintained as a general monochrome instrument while saving cost.

Figure 3:
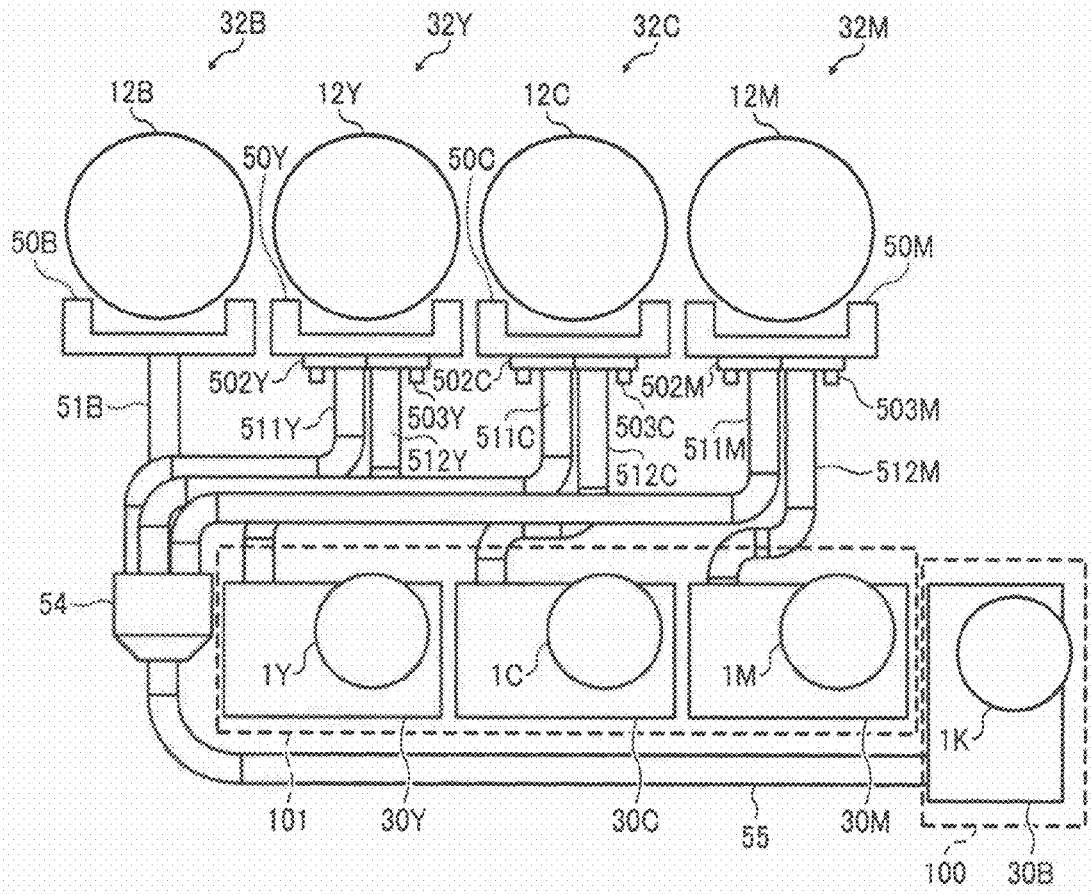
FIG. 3 schematically illustrates exemplary toner supply units for supplying the respective component color toner and peripherals thereof.

Further, the secondary toner supply units 32Y to 32M are enabled to be used as toner supply units 32B-Y to 32B-M which supply black toner to the developing device 3B after the recycling as described below with reference to FIG. 3.

As shown, a conveyance path joint 54 is arranged on a toner conveyance path (51B) for the first toner supply unit 32B as a confluence section where first conveyance paths of the second toner supply units 32Y to 32M flow together. Specifically, the conveyance tube 51B is connected to a connection opening of the nozzle 501B of the black bottle setting table 50B at one end, and is connected to the conveyance path joint 54 at the other end. A common tube 55 is connected to the conveyance path joint 54 at one end, and is connected to the screw pump 52B (30B?) at the other end (see FIG. 3).

The second toner supply units 32Y to 32M respectively include first and second conveyance tubes 511Y to 511M and 512Y to 512M, respectively, to serve as the first and second conveyance paths. The first conveyance tubes 511Y to 511M are connected to first connection openings of the bottle setting tables 50Y to 50C mentioned later in detail at their one ends, respectively. The first conveyance tubes 511Y to 511M are connected to the conveyance path joint 54 at their other ends.

The second conveyance tubes 512Y to 512M are connected to the second connection openings of the bottle setting tables 50Y to 50C mentioned later in detail at their one ends, respectively. The second conveyance tubes 512Y to 512M are also connected to the screw pumps 52Y to 52M (?) at their other ends, respectively.

Figure 4A:
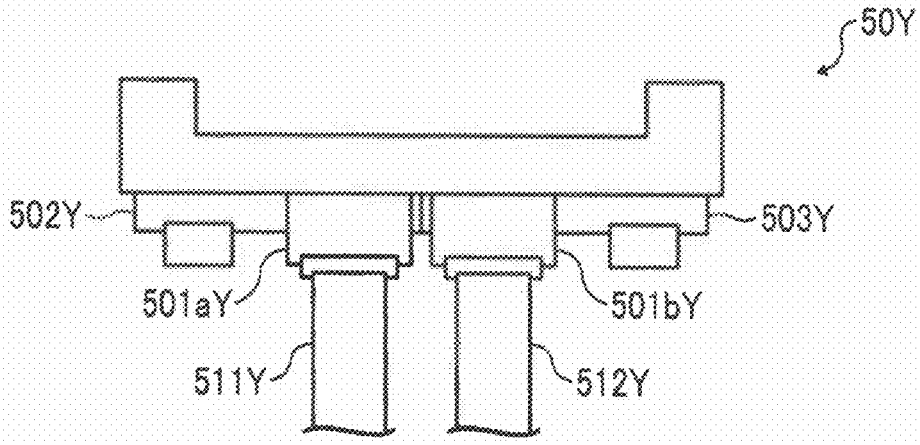
FIGS. 4A and 4B schematically illustrate an exemplary bottle-setting table for setting a yellow toner bottle.

Now, an exemplary Y-color bottle setting table is specifically described with reference to FIGS. 4A and 4B, and sometime to FIG. 2. As shown in FIG. 4A, a nozzle 501B (see FIG. 2) attached to the bottle setting table 50Y includes first and second connection openings 501*a*Y and 501*b*Y serving as first and second toner supply openings, respectively. One end of the first conveyance tube 511Y is connected to the first connection opening 501*a*Y, while one end of the second conveyance tube 512Y is connected to the second connection opening 501*b*Y.

Figure 4B:
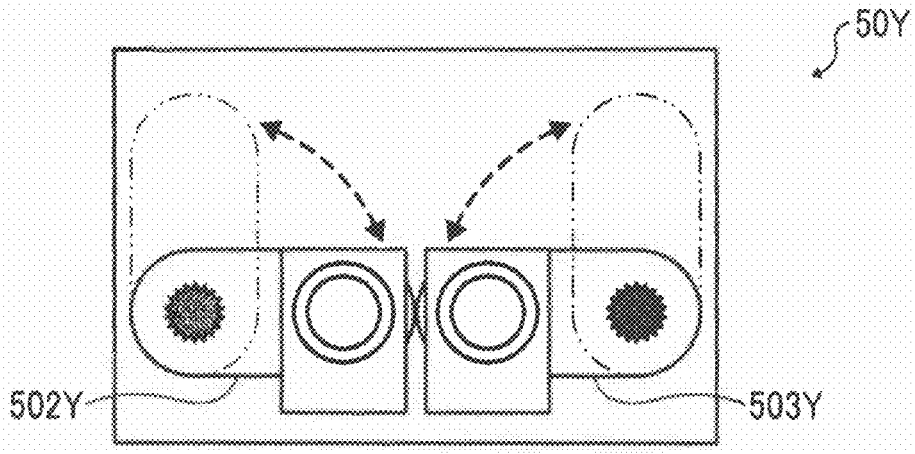

As shown in FIG. 4B, shutter mechanisms 502Y and 503Y are freely rotatably attached to the lower surface of the bottle setting table 50Y to open and close first and second connection openings 501*a*Y and 501*b*Y, respectively. Instead of rotating, these shutter mechanisms 502Y and 503Y can be slidable between the first and second connection openings to open and close one of the first and second connection openings 501*a*Y and 501*b*Y.

Further, the remaining M and C color bottle setting tables 50M and 50C have substantially the same configuration as the Y-color bottle setting table 50Y.

Figure 5A:
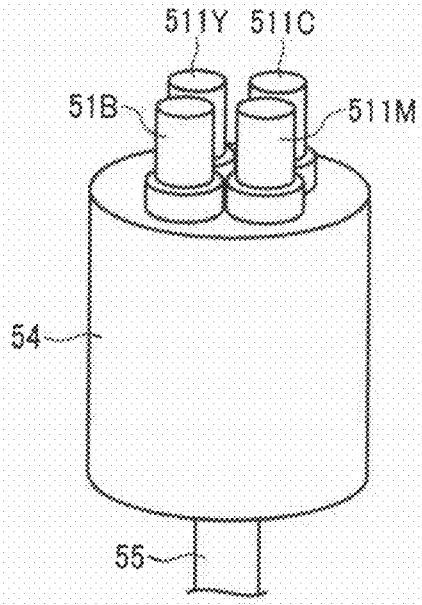
FIGS. 5A and 5B schematically illustrate an exemplary conveyance path joint.

Now, an exemplary conveyance path joint 54 is more specifically described with reference to FIGS. 5A and 5B. As shown, four inlet openings are separately formed on the upper surface of the conveyance path joint 54 of the confluence section. The conveyance tube 51B and the first conveyance tubes 511Y to 511M are connected to these different four inlet openings, respectively.

Figure 5B:
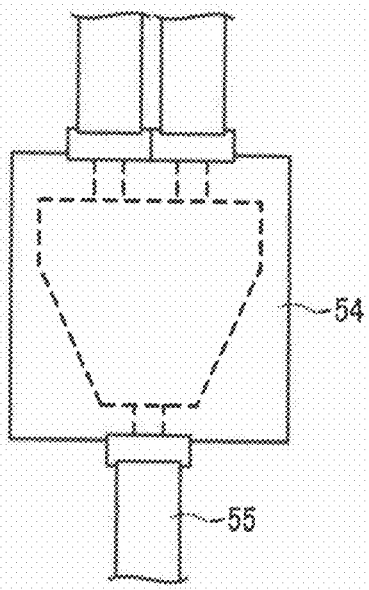

As shown by a dotted line in FIG. 5B, an inside of the conveyance path joint 54 tucks downwardly and includes an outlet opening on the bottle surface thereof as a tucking end. Thus, paths of the respective toner supply units are combined with each other in the conveyance path joint 54. Further, the common tube 55 is connected to the outlet opening. Since the interior of the conveyance path joint 54 tucks toward the outlet opening, toner is smoothly ejected therethrough without getting stacked up there.

Figure 6A:
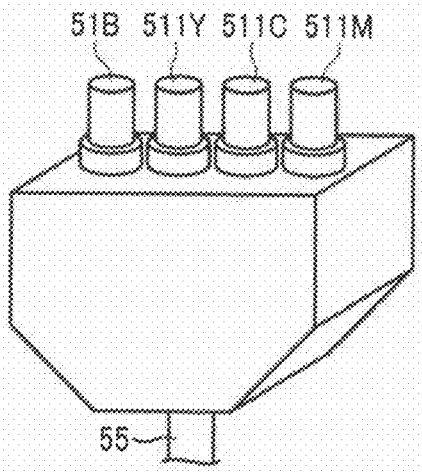
FIGS. 6A and 6B schematically illustrate another exemplary conveyance path joint.
Figure 6B:
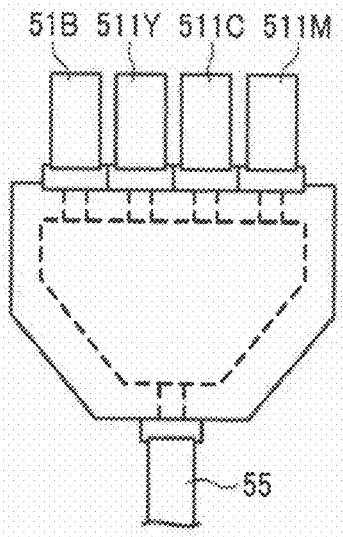

Further, the inlet openings can be arranged side by side as shown in FIGS. 6A and 6B. Further, exterior and interior shapes of the conveyance path joint 54 are not limited to the types of FIGS. 5A, 5B, 6A and 6B.

Further, the respective tubes 51B, 511Y to 511C, 512Y to 512C, and 55 are made of silicone having 10 mm and 6 mm of outer and inner diameters.

When the image forming apparatus is used as a color copier, the first connection opening is closed by the first shutters 502 of the bottle setting tables 50Y to 50C to cause the second shutter 503 to take posture as shown by a dotted line of FIG. 5 and to open the second connection opening. Then, toner bottles storing color toner are set to the corresponding bottle setting tables 50Y to 50C, respectively, as shown in FIG. 3.

Thus, Y color toner stored in the toner bottle 12Y set to the bottle setting table 50Y is supplied to the developing device 3Y of the Y cooler process unit 30Y from the nozzle 501Y of the bottle setting table 50Y, the second connection opening, and their second conveyance tube 512Y serving as the second conveyance path. Similarly, C and M color toner stored in the toner bottles 12C and 12M set to the bottle setting tables 50C and 50M are supplied to the developing devices 3C and 3M by traveling from the nozzles of the bottle setting tables 50C and 50M, their second connection openings, and the second conveyance tubes 512C and 512M, respectively.

Further, B color toner stored in the toner bottle 12B set to the bottle setting table 50B is supplied to the K-color developing device 3B through the conveyance tube 51B, the conveyance path joint 54, and the common tube 55.

When the image forming apparatus of the color instrument is recycled as the monochrome instrument, the color image formation unit 101 and a color driving unit, not shown, are detached. However, the second toner supply units 32Y to 32M are left in the apparatus body to be recycled as a toner supply unit for supplying black toner. Specifically, the second connection openings are closed by the second shutters 503Y to 503M to cause the first shutters 502Y to 502M to take postures as shown by dotted lines of FIG. 4 and to open the first connection openings, respectively. Then, the toner bottles 12B storing black toner are set to the respective bottle setting tables 50Y to 50M.

Thus, the B-color toner stored in the toner bottle 12B set to the bottle setting table 50Y is supplied to the conveyance path joint 54 while traveling from the nozzle of the bottle setting table 50Y and the first connection opening through the first conveyance tube 511Y serving as the first conveyance path. The B-color toner is, then, supplied to the developing device 3B of the B-color process unit 30B through the common tube 55 from the conveyance path joint 54. Similarly, the B-color toner stored in the toner bottles 12B set to the bottle setting tables 50C and 50M, respectively, is supplied to the conveyance path joint 54 from the first connection opening through the nozzles of the bottle setting tables 50C and 50M and the first conveyance tubes 511C and 511M. The B color toner is then supplied to the developing device 3B of the B color process unit 30B through the common tube 55 from the conveyance path joint 54.

Further, the other ends of the second conveyance tubes 512Y to 512M connected to the screw pumps 52Y to 52M are held at their one ends by prescribed holder sections, not shown, provided in the apparatus body, respectively. Otherwise, the second conveyance tubes 512Y to 512M are detached from the apparatus body.

In this way, when the color instrument is recycled as the monochrome instrument, the second toner supply units 32Y to 32C are switched to be the toner supply units 32B-Y to 32B-M for recycling. Thus, products can be recycled saving natural resources.

An exemplary operation of supplying black toner from the toner supply units 32B, 32B-Y to 32B-M is now described.

Initially, a container body 122B of the toner bottle 12B set to the toner supply unit 32B is rotated by controlling the toner supply unit 32B, so that toner stored in the toner bottle 12B is supplied to the B color developing device 3B. When the end of the toner of the toner bottle 12B set to the toner supply unit 32B is detected, the container body 122B of the toner bottle 12B set to the toner supply unit 32B-Y is rotated by controlling the toner supply unit 32B-Y, and toner stored in the toner bottle 12B is supplied to the B color developing device 3B. When the end of the toner of the toner bottle 12B set to the toner supply unit 32B-Y is detected, the similar control operations as mentioned above are executed by controlling the toner supply unit 32B-C. When the end of the toner of the toner bottle 12B set to the toner supply unit 32B-C is detected, the similar control operations as mentioned above are executed by controlling the toner supply unit 32B-M. Since the toner is continuously supplied from the toner supply units even if the toner stored in the precedent toner supply unit is used up, a downtime taken by replacement of toner bottles due to toner empty during a printing operation can be suppressed. Further, since the other toner supply unit supplies toner when one of toner supply units is malfunctioned, printing can be continued even during a repairing operation by a service person. Thus, a downtime can be decreased.

Figure 7A:
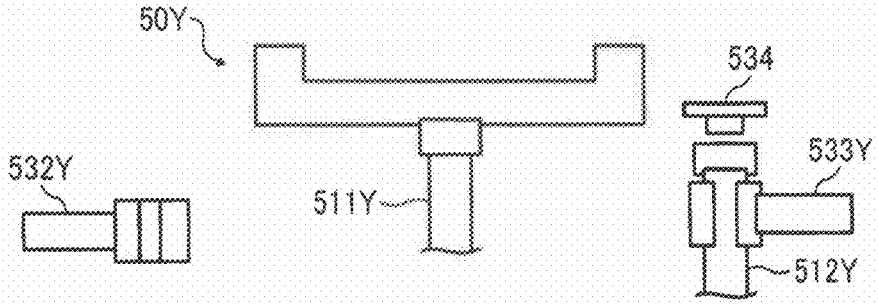
FIGS. 7A and 7B schematically illustrate a principal part of an exemplary first modification of a yellow toner supply unit 32Y used in the monochrome instrument.
Figure 7B:
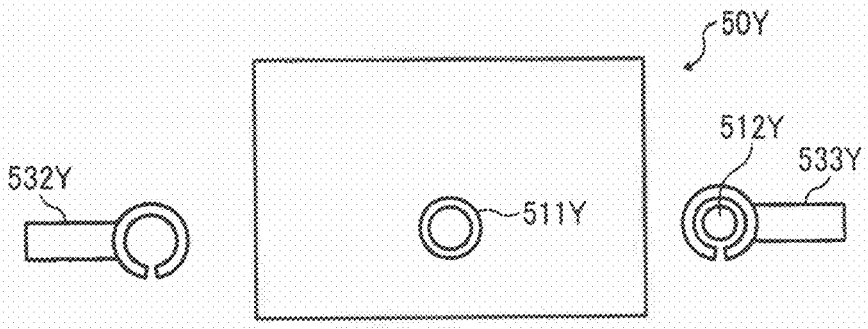

Now, exemplary modifications are described with reference to FIGS. 7A and 7B.

Now, a first modification of the Y color toner supply unit 32Y is described with reference to FIGS. 7A and 7B. As shown, a bottle setting table 50Y similarly includes only one connection opening connecting to a nozzle as the B color bottle setting table 50B. A first holder section 522Y is provided on the left below side of the bottle setting table 50Y to hold the first conveyance tube 511Y. A second holder section 523Y is also provided on the right below side of the bottle setting table 50Y to hold the second conveyance tube 512Y.

Figure 8:
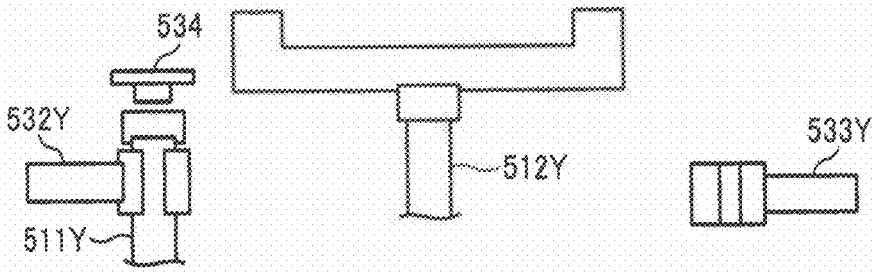
FIG. 8 schematically illustrates a principal part of an exemplary first modification of the yellow toner supply unit 32Y used in the color instrument.

When the image forming apparatus is used as a color instrument, one end of the second conveyance tube 512Y is connected to the nozzle connection opening. Then, one end of the first conveyance tube 511Y is connected to and held by the first holder section 522Y and is closed by the cap 524 as shown in FIG. 8.

Whereas when the image forming apparatus of the color instrument is recycled as the monochrome instrument, the one end of the second conveyance tube 512Y is detached from the nozzle connection opening, and is held by the second holder section 523Y. The cap 524 then closes the one end of the second conveyance tube 512Y. Even not shown, the other end of the second conveyance tube 512Y is held by a prescribed holder provided in the apparatus body.

Then, the one end of the first conveyance tube 511Y is detached from the first holder section 522Y and the cap 524 is detached therefrom. Subsequently, the one end of the first conveyance tube 511Y is connected to the nozzle connection opening of the bottle setting table 50Y as shown in FIGS. 7A and 7B.

After that, the toner bottle 12B storing B color toner is attached and set to the bottle setting table 50Y to be supplied therefrom.

As a result, the Y color toner supply unit 32Y that supplies Y color toner to the Y color developing device 3Y is recycled as the B color toner supply unit 32B-Y that supplies B color toner to the B color developing device 3B.

The above-mentioned second holder section 523Y can be omitted if the second conveyance tube 512Y is detached from the image forming apparatus body together with a screw pump 52Y. Further, the above-mentioned modification can be adopted in the respective C and M color toner supply units 32C and 32M.

Only one conveyance tube can be employed instead of the above-mentioned first and second conveyance tubes 511Y and 512Y, if the other end of the conveyance tube connected to the suction opening 523 of the screw pump 52 at one end is connected to the inlet opening of the conveyance path joint 54.

Further, if the Y, M, to C color screw pumps 52 are arranged in the vicinity of the conveyance path joint 54 when recycled, the conveyance tube can be smoothly wired without largely changing a route.

Thus, the image forming apparatus of this embodiment includes the B color image formation unit 100 serving as the first image formation unit for forming the black toner image, and the color image formation unit 101 serving as the second image formation units for forming the full-color toner image. Also included are the bottle setting table serving as a first toner container section, a B color toner supply unit as the first toner supply unit that supplies black toner stored in the toner bottle set to the bottle setting table to the B image formation unit 100, and the second toner supply units 32Y to 32M that supply color toner of Y to M colors stored in the toner bottles set to the bottle setting tables to the color image formation unit 101. By at least detaching the color image formation unit 101 from the image forming apparatus body, the image forming apparatus can be changed from the color image forming apparatus capable of forming a color image to the image forming apparatus only capable of forming a monochrome image.

Further, the second toner supply units 32Y to 32M are enabled to select and use one of the first and second conveyance paths that convey toner stored in the toner bottles set to the bottle setting tables to the B and full-color image formation units 101 and 101, respectively.

Due to such a configuration, when the image forming apparatus is used as the color instrument, the toner bottles storing the color use toner are set to the bottle-setting tables, and the second toner supply unit is enabled to select and use the second conveyance path that convey the toner stored in the toner bottles to the full-color image formation unit 101, so that the full-color use toner is conveyed to the full-color image formation unit 101. Whereas when the image forming apparatus is recycled as the monochrome instrument, the toner bottle storing the black color use toner is set to the bottle setting table, and the second toner supply unit is enabled to select and use the first conveyance path that conveys the toner in the toner bottle to the black color image formation unit 100, so that the black toner is conveyed to the black color image formation unit 100. Owing to this, when the color instrument is recycled as the monochrome instrument, the second toner supply unit does not need to be detached and recycled as the toner supply unit that supplies the black toner to the B color image formation unit 100, whereby saving the natural resource of the products.

Further, the conveyance path joint 54 is arranged on the conveyance path of the B color toner supply unit as an interflow section where the first conveyance path of the second toner supply unit interflows. Thus, the connection opening for connecting the first conveyance path of the second toner supply unit can be omitted from the B color image formation unit. Thus, the B color image formation unit can be downsized.

Further, since only one connection opening suffices, the configuration of the B color image formation unit can be simplified.

Further, the second toner supply unit includes a conveyance tube that conveys toner stored in the toner bottle set to the bottle setting table, and one end of the conveyance tube is secured to the bottle setting table, while the other end is enabled to be detachable to both of the conveyance path connection opening 54 and the color image formation unit 101. Thus, only one conveyance tube suffices, and accordingly instrument cost and natural resource can be saved.

Further, the second toner supply unit includes a first conveyance tube with its one end being secured to the conveyance path joint 54, and the second conveyance tube with its one end being secured to the color image formation unit 101. Then, toner stored in the toner bottle set to the bottle setting table is alternately supplied to one of the first and second conveyance tubes.

Specifically, the bottle setting table includes the first connection opening as a first toner supply opening to which the other end of the first conveyance tube is attached, the second connection opening as a second toner supply opening to which the other end of the second conveyance tube is attached, and a shutter mechanism that opens and closes the first and second connection openings. When the image forming apparatus is used as the color instrument, the second shutter of the shutter mechanism is open while the first shutter is closed.

Thus, toner stored in the toner bottle set to the bottle setting table can be supplied to the second conveyance tube. Where as, when the image forming apparatus is used as the monochrome instrument, the first shutter of the shutter mechanism is open while the second shutter is closed. Thus, toner stored in the toner bottle set to the bottle setting table can be supplied to the first conveyance tube. In this way, only by opening or closing the first and second shutters, the second toner supply unit can be alternately used from the full-color use to the monochrome use, so that recycling is readily achieved. Thus, a user who bought or leased a color instrument can recycle from a color instrument of an image forming apparatus to a monochrome instrument by himself or herself. Further, when recycling is executed in a factory, a manufacturer can reduce labor time while saving recycling cost of the apparatus.

Further, as shown in the first modification, the number of connection openings provided on the bottle setting tables as toner supply openings are decreased to one, while providing a holder section for holding a conveyance tube not connected to the connection opening. As a result, the instrument cost can be saved. Further, only by exchanging the conveyance tubes, the second toner supply unit can be recycled from the full-color use to the monochrome use. Thus, switching to the monochrome use becomes available decreasing a labor time. As a result, the recycling cost can be saved.

Further, the B color image formation unit 100 is arranged one of upstream and downstream of a secondary transfer position where an image formed by a color image forming apparatus is secondary transferred, and a toner image formed by a B color photoconductive member is directly transferred onto a recording medium. Thus, the same productivity can be assured as a typical monochrome instrument. Thus, even if the full-color instrument is recycled as a monochrome instrument, the first print avertable time is equivalent to that of the typical monochrome instrument.

According to one embodiment of the present invention, when the color instrument is recycle as the monochrome instrument, the second toner supply units is recycled, so that products are recycled and resources can be saved.

Numerous additional modifications and variations of the present invention are possible in latent image of the above teachings. It is therefore to be understood that within the scope of the appended claims, the present invention may be practiced otherwise that as specifically described herein.

What is claimed is:

1. An image forming apparatus, comprising:

a first image formation unit configured to form a black toner image;

a second image formation unit configured to form component color toner images, said second image formation unit attachably detachable from the image forming apparatus;

a first toner supply unit having a first toner container holder and configured to supply toner stored in a first toner container held on the first toner container holder to the first image formation unit;

second toner supply units having second toner container holders and each configured to supply toner stored in second toner containers held on the second toner container holders to the second image formation unit, wherein each of said second toner supply units includes a first toner conveyance path configured to convey black toner to the first image formation unit when the second image formation unit is detached and the second toner containers held on the second toner container holders store the black toner, said second toner supply units each include a second toner conveyance path configured to convey component color toner to the second image formation unit when the second image formation unit is attached and the second toner containers held on the second toner container holders store the component color toner, wherein one of said first and second toner conveyance paths is selectively used in accordance with the detachment of the second image formation unit.

2. The image forming apparatus as claimed in claim 1, wherein said first toner supply unit includes a black toner conveyance path configure to guide and supply the black toner stored in the first toner container toward the first image formation unit, said black toner conveyance path including an interflow section where the first toner conveyance paths interflow.

3. The image forming apparatus as claimed in claim 2, wherein said second toner supply units include conveyance tubes secured to the second toner container holders at one end, and selectively detached and attached to one of the interflow section collectively and the second image formation units, respectively, at the other end in accordance with the detachment of the second image formation unit.

4. The image forming apparatus as claimed in claim 2, wherein said second toner supply units include first toner conveyance tubes configured to guide the black color toner from the second toner containers held on the second toner container holders, respectively, one end of said first conveyance tubes being secured to the interflow section, collectively, said second toner supply units including second conveyance tubes, one end of said second conveyance tubes being secured to the second image formation units, respectively, and wherein one of said first and second conveyance tubes is selectively used in accordance with the detachment of the second image formation unit.

5. The image forming apparatus as claimed in claim 4, wherein each of said second toner container holders includes:

a first toner supply opening to which one end of the first conveyance tube is attached;

a second toner supply opening to which one end of the second conveyance tube is attached; and at least two shutters each configured to open and close the first and second toner supply openings in accordance with the detachment of the second image formation unit.

6. The image forming apparatus as claimed in claim 4, wherein each of said toner container holders includes:

a toner supply opening to which one end of the first and second conveyance tubes is alternately connected; and a tube holder configured to hold one of the first and second conveyance tubes not connected to the toner supply opening.

7. The image forming apparatus as claimed in claim 1, wherein said second image formation unit includes:

at least one second image bearer configured to bear at least one component color toner image;

at least one second image forming device configured to form the at least one component color toner image on the at least one second image bearer;

an intermediate transfer member configured to receive a primarily transfer of the at least one component color toner image from the at least one second image bearer;

a primary transfer device configured to primary transfer the at least one component color toner image from the at least one second image bearer to the intermediate transfer member; and a secondary transfer device configured to secondarily transfer the at least one component color toner image from the intermediate transfer member onto a recording medium, wherein said first image formation unit includes:

a first image bearer configured to bear the black toner image, said first image bearer being arranged either upstream or downstream of a secondary transfer position in a recording medium conveyance direction, where the at least one component color toner image is secondary transferred from the intermediate transfer member to the recording medium;

a first image forming device configured to form the black toner image on the first image bearer; and a direct transfer device configured to directly transfer the black toner image from the first image bearer onto the recording medium.

* * * * *